US005580231A

United States Patent [19]

Yasui

[11] Patent Number: 5,580,231

[45] Date of Patent: Dec. 3, 1996

[54] SWING TYPE ROTARY COMPRESSOR HAVING AN OIL GROOVE ON THE ROLLER

[75] Inventor: Yoshiki Yasui, Kusatsu, Japan

[73] Assignee: Daikin Industries, Ltd., Osaka, Japan

[21] Appl. No.: 507,416

[22] PCT Filed: Dec. 19, 1994

[86] PCT No.: PCT/JP94/02130

§ 371 Date: Aug. 24, 1995

§ 102(e) Date: Aug. 24, 1995

[87] PCT Pub. No.: WO95/18310

PCT Pub. Date: Jul. 6, 1995

[30] Foreign Application Priority Data

Dec. 24, 1993 [JP] Japan ..... 5-328762

[51] Int. Cl.[6] ..... F04C 18/32

[52] U.S. Cl. ..... 418/66; 418/94

[58] Field of Search ..... 418/64–67, 91, 418/94

[56] References Cited

U.S. PATENT DOCUMENTS

| | | | |
|---|---|---|---|
| 1,137,215 | 4/1915 | Kinney | 418/66 |
| 2,018,521 | 10/1935 | Heitman | 418/88 |
| 2,169,131 | 8/1939 | Albertson | 418/66 |
| 3,499,600 | 3/1970 | McGregor . | |

FOREIGN PATENT DOCUMENTS

| | | | |
|---|---|---|---|
| 0154347 | 9/1985 | European Pat. Off. . | |
| 58-158393 | 9/1983 | Japan . | |
| 59-32691 | 2/1984 | Japan . | |
| 63-219889 | 9/1988 | Japan | 418/94 |
| 2-207188 | 8/1990 | Japan . | |
| 3-70890 | 3/1991 | Japan . | |
| 4-10393 | 3/1992 | Japan . | |
| 5-202874 | 8/1993 | Japan . | |
| 534169 | 2/1941 | United Kingdom | 418/66 |

*Primary Examiner*—John J. Vrablik

*Attorney, Agent, or Firm*—Birch, Stewart, Kolasch & Birch, LLP

[57] ABSTRACT

In a rotary compressor, a roller (6) fitted around an eccentric portion (51) of a drive shaft (5) is provided in a cylinder chamber- (21) of a cylinder (2) in such a way that the roller (6) is revolvable around the drive shaft (5). A blade (61) provided integrally with and protruding from the roller (6) is swingably supported by a support member (62) rotatably provided in the cylinder (2). An oil groove (64) opened at axial end faces of the roller (6) is formed on the inner peripheral surface of the roller (6) on a counter loaded side and within a range from a position where the blade (61) is protrusively provided, to another position 180 degrees displaced therefrom in the rotating direction of the drive shaft (5), whereby oil can be positively fed from the oil groove (64) to sliding surfaces. With such an arrangement, the rotary compressor is lubricated more successfully at the outer peripheral surface of the eccentric portion (51) of the drive shaft (5) and at the inner peripheral surface of the roller (6), even in an overloaded operation, despite being a swing type rotary compressor in which the roller (6) is driven into revolution. As a result, the compressor can be prevented from seizure and wear and improved in the machine reliability.

10 Claims, 4 Drawing Sheets

SWING TYPE ROTARY COMPRESSOR HAVING AN OIL GROOVE ON THE ROLLER

DESCRIPTION

1. Technical Field

The present invention relates to a swing type rotary compressor primarily for use in a refrigerator.

2. Background Art

Conventionally, a swing type rotary compressor has been known in which, as described in Japanese Patent Laid-Open Publication HEI 5-202874, a blade for dividing a cylinder chamber into a suction chamber and a compression chamber is integral with and projects from a roller which is fitted around an eccentric portion of a drive. shaft, where the blade is swingably supported by a receptive groove of a support member rotatably provided to the cylinder so that gaseous fluid is compressed with the roller moving around. More specifically, in the conventional swing type rotary compressor, as shown in FIG. 6, an eccentric portion D1 of a drive shaft D is inserted in a cylinder chamber A1 of a cylinder A, and a roller B is fitted to the eccentric portion D1. Moreover, a blade B1 protruding radially is provided integrally with the roller B. The blade B1 is supported by a receptive groove Cl of a cylindrical support member C rotatably held within the cylinder A in such a way that the blade B1 is swingable and forward-and-backward movable. The interior of the cylinder chamber A1 is divided into a compression chamber and a suction chamber by the roller B and the blade B1. Rotation of the drive shaft D causes the roller B to be driven into revolution around the shaft, and the revolution of the roller B in turn causes gaseous fluid to be sucked into the suction chamber and compressed in the compression chamber.

However, in the above-described swing type rotary compressor, because of its construction that the blade B1 is integral with the projects from the roller B and is supported by the support member C so as to be swingable and forward-and-backward movable, even if the roller B is driven into revolution by the rotation of the eccentric portion D1 of the drive shaft D, the roller B will not rotate itself. As a result, the peripheral speed of the outer peripheral surface of the eccentric portion D1 relative to the inner peripheral surface of the roller B is increased. On this account, under demanding lubricating conditions such as in an overloaded operation, the lubrication between the outer peripheral surface of the eccentric portion D1 and the inner peripheral surface of the roller B would worsen so that seizure or wear occurs, giving rise to a problem of deteriorated machine reliability.

DISCLOSURE OF INVENTION

The present invention has been developed in view of the above described disadvantages. The object of the present invention is therefore to provide a swing type rotary compressor which positively feeds oil between the outer peripheral surface of the eccentric portion and the inner peripheral surface of the roller even when a peripheral speed between the outer periphery of the eccentric portion of the drive shaft and the inner periphery of the roller is high, so that a successful lubrication therebetween can be obtained even under an overloaded operation, whereby the compressor can be prevented from seizure and wear and therefore improved in the machine reliability.

In order to achieve the aforementioned object, a swing type rotary compressor of the present invention comprises a cylinder having a cylinder chamber formed therein, a roller fitted around an eccentric portion of a drive shaft and installed in the cylinder chamber, a blade integrally formed with and projects from the roller and dividing the cylinder chamber into a compression chamber and a suction chamber, a support member swingably provided in the cylinder and having a receptive groove for receiving a tip portion of the blade in such a way that the tip portion can freely move forward and backward, and an oil groove which is formed on an inner peripheral surface of the roller on a counter loaded side and within a range from a first position where the blade projects therefrom to a second position displaced from the first position 180 degrees in a rotating direction of the drive shaft, and which is opened at both axial end faces of the roller.

In the swing type rotary compressor with the above arrangement, an oil groove is provided on the inner peripheral surface of the roller on the counter loaded side and within the range from the position where the blade projects from the roller to another position displaced 180 degrees in the rotating direction of the drive shaft from the first position, and the oil groove is opened at both axial end faces of the roller. Therefore, with the eccentric portion rotating, the oil in the oil groove is fed by its viscosity to between sliding surfaces on the counter loaded side of the roller having a relatively large gap between the roller and the eccentric portion. Also, the oil fed out from the oil groove 64 to between the sliding surfaces in this way causes a differential pressure to arise between a center portion of the oil groove 64 and its both open ends. As a result, oil reserved at both end sides of the eccentric portion is fed into the oil groove from both open ends of the oil groove forcedly by the differential pressure. Accordingly, the oil groove can be always filled with oil, so that the sliding portions can positively be fed with oil. Still, since the oil groove is formed over the entire length in the axial direction, oil can securely be fed to the overall outer peripheral surface of the eccentric portion. Since oil can be thus positively fed to the sliding portions of the roller and the eccentric portion from the oil groove provided on the counter loaded side of the roller, and moreover the oil fed from the oil groove can be successfully fed to the sliding surfaces on the loaded side through the rotation of the eccentric portion, the lubricating performance between the outer peripheral surface of the eccentric portion and the inner peripheral surface of the roller can be improved. Consequently, even under severe lubricating conditions, such as in an overloaded operation, the compressor can be prevented from wear and seizure and therefore improved in the machine reliability.

In an embodiment, the oil groove is slanted with respect to the axial direction of the roller. For example, when oil is reserved more on an end face side of the eccentric portion closer to the front head, the oil groove may be formed obliquely in the rotating direction of the drive shaft from the front head side toward the rear head side, so that the oil reserved more on the front head side can be made to positively flow toward the rear head from the opening of the oil groove opened on the front head side, and therefore more successful lubrication of the sliding portions can be attained. Also, conversely, when oil is reserved more on an end face side of the eccentric portion closer to the rear head, the oil groove may be formed obliquely in the counter rotating direction of the drive shaft from the front head side toward the rear head side, so that oil reserved more on the rear head side can be made to positively flow from the rear head side opening toward the front head. In either case, oil can be fed from a side on which oil is reserved in a larger amount toward the other side via the oil groove, so that the lubrication of the sliding portions can be attained more successfully.

In another embodiment, the oil groove is formed on a slant forward in the rotating direction of the eccentric portion from a portion of the roller opposite to an oil feed hole of the eccentric portion of the drive shaft. In this case, while oil fed out through the oil feed hole formed at an axially intermediate portion of the eccentric portion is pushed to flow in the oil groove outward in the axial direction by the rotation of the drive shaft, the oil is taken in between the sliding surfaces by the outer peripheral surface of the eccentric portion and delivered to both the front head and rear head sides. Thus, oil can be fed over the entire sliding surfaces of the inner periphery of the roller and the outer periphery of the eccentric portion.

BEST MODE FOR CARRYING OUT THE INVENTION

Figure 1:
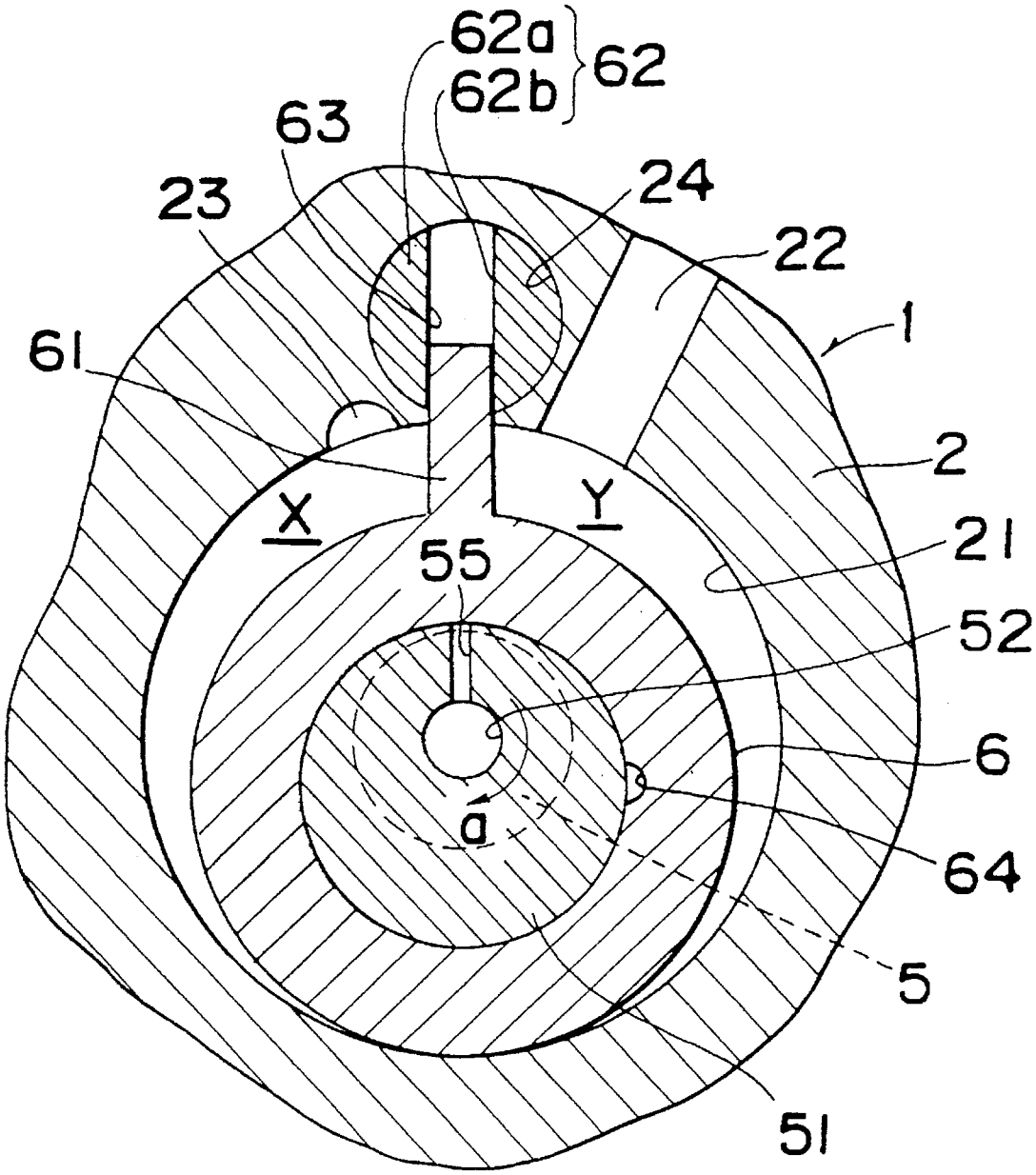
FIG. 1 is a transverse sectional view of a compression unit in a first embodiment of the swing type rotary compressor according to the present invention.
Figure 2:
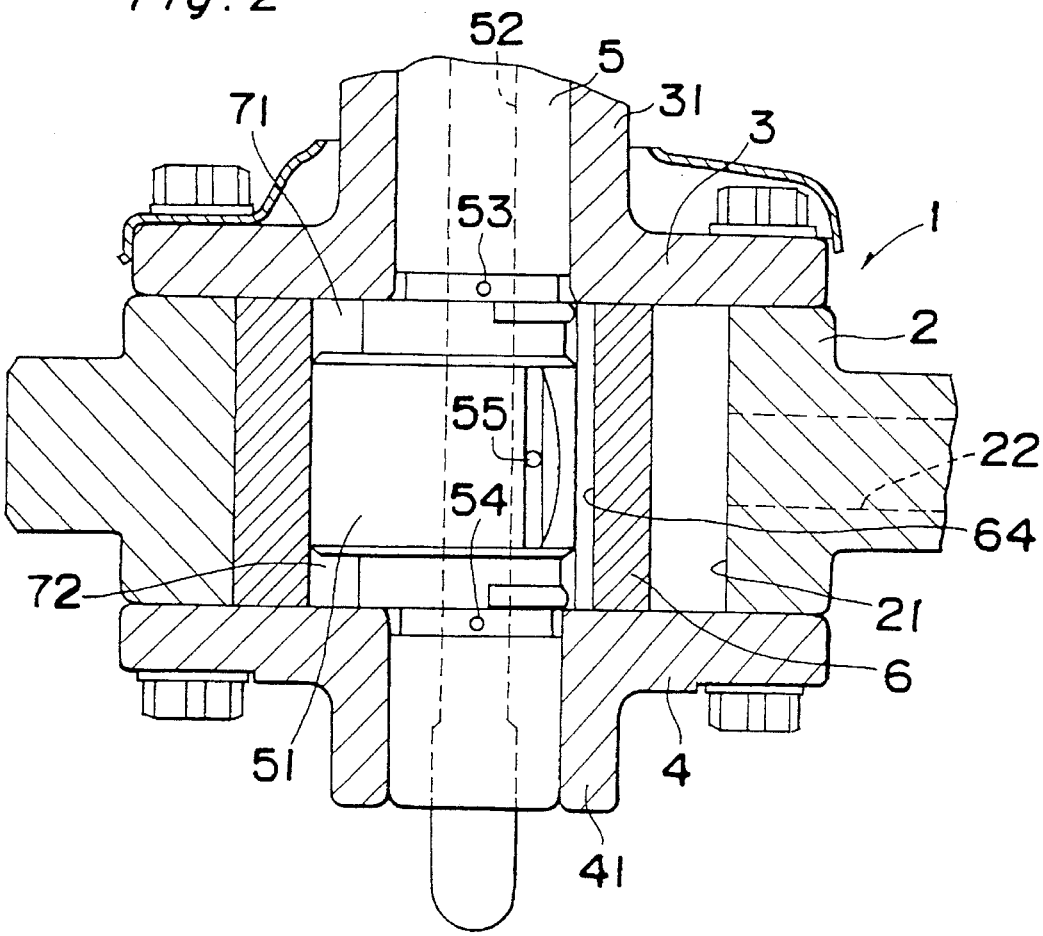
FIG. 2 is a longitudinal sectional view of the compression unit in the same embodiment.

A first embodiment of the present invention is described with reference to FIGS. 1 to 3. The swing type rotary compressor of this embodiment has a compression unit 1, which is installed within a closed casing (not shown), as shown in FIGS. 1 and 2. This compression unit comprises a front head 3 and a rear head 4, and a cylinder 2. Within a cylinder chamber 21 of the cylinder 2, there is provided a roller 6 which has a blade 61 provided integrally therewith and projects outwardly in the radial direction, and which has the same length as the axial length of the cylinder chamber 21. An eccentric portion 51 of a drive shaft 5 is fitted in the roller 6. By this arrangement, the roller 6 is revolved around the drive shaft through the rotation of the drive shaft 5, with the outer peripheral surface of the roller 6 being kept in contact with the inner wall surface of the cylinder chamber 21 via an oil film and with both axial end faces of the roller 6 being kept in contact with facing surfaces of the front head 3 and the rear head 4 via an oil film. Further, a circular support hole 24 communicating with the interior of the cylinder chamber 21 is formed at an intermediate portion between a suction hole 22 and a discharge hole 23 provided in the cylinder 2. A support member 62 put into sliding contact with the heads 3, 4 is rotatably supported in the support hole 24. The blade 61 is supported by a receptive groove 63 provided in the support member 62 in such a way that the blade 61 can swing as well as move forward and backward. The support member 62 is formed of two members 62*a*, 62*b* of a semi-cylindrical shape, the receptive groove 63 is defined between flat opposing surfaces of the members 62*a*, 62*b*, and the blade 61 is inserted into the receptive groove 63.

In the above construction, the interior space of the cylinder chamber 21 is divided by the roller 6 and the blade 61 into a suction chamber Y communicating with the suction hole 22 and a compression chamber X communicating with the discharge hole 23. Thus, as the drive shaft 5 rotates, gas is sucked through the suction hole 22 into the suction chamber Y, and the sucked gas is compressed in the compression chamber X and discharged through the discharge hole 23.

In the swing type rotary compressor constructed as shown in FIGS. 1 and 2, generally, the axial length of the eccentric portion 51 is shorter than the axial length of the roller 6. As a result, spaces 71, 72 are formed between the upper end surface of the eccentric portion 51 and the facing surface of the front head 3 and between the lower end surface of the eccentric portion 51 and the facing surface of the rear head 4, respectively. Via these spaces 71, 72, the outer peripheral surface of the shaft portion of the drive shaft 5, which is supported by bearing portions 31, 41 of the front head 3 and the rear head 4, and the inner peripheral surface of the roller 6 communicate with each other at both their upper and lower sides. Also, the gap between the outer peripheral surface of the eccentric portion 51 and the inner peripheral surface of the roller 6 is opened to the spaces 71, 72. Moreover, the spaces 71, 72 reserve oil that is to be fed to the bearing portions 31, 41 of the front head 3 and the rear head 41, respectively. In more detail, normally, an oil feed hole 53 for feeding oil in an oil passage 52 formed inside the drive shaft 5 to the bearing portion 31 of the front head 3 is opened in the drive shaft 5 at such a position as to oppose the foot portion of the bearing 31. Also, an oil feed hole 54 for feeding oil in the oil passage 52 to the bearing portion 41 of the rear head 4 is opened in the drive shaft 5 at such a position as to oppose the foot portion of the bearing portion 41. Therefore, by forming the spaces 71, 72 between the upper and lower end surfaces of the eccentric portion 51 and the faces of the heads 3, 4, part of the oil fed through the oil feed holes 53, 54 is reserved in the spaces 71, 72, respectively.

Besides, an oil feed hole 55 communicating with the oil passage 52 of the drive shaft 5 is formed at an axially intermediate portion of the eccentric portion 51. Thus, oil is fed to between the outer peripheral surface of the eccentric portion 51 and the inner peripheral surface of the roller 6 through the oil feed hole 55.

Furthermore, an oil groove 64 opened at the axial end surfaces of the roller 6 is formed on the inner peripheral surface of the roller 6 on the counter loaded side within a range from a position where the blade 61 projects from the roller 6 to another position displaced from the blade provision position 180 degrees in a rotating direction a of the drive shaft 5.

Figure 3:
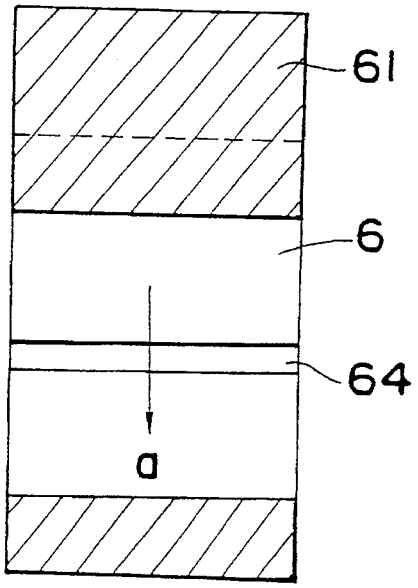
FIG. 3 is a sectional view of the roller in the same embodiment.

In more detail, the oil groove 64, as shown in FIG. 3, is formed on the counter loaded side of the inner peripheral surface of the roller 6 so as to be parallel to the axial direction. With the arrangement that the oil groove 64 is formed parallel to the axial direction, not only the oil fed through the oil feed hole 55 formed in the eccentric portion 51 is fed into the oil groove 64, but also the oil reserved in the spaces 71, 72 is fed into the oil groove 64 through both the end openings of the oil groove 64. Further, since the oil groove 64 is provided on the counter loaded side of the roller 6, where the gap between the roller 6 and the eccentric portion 51 is relatively large, the oil fed to the oil groove 64 is sent out to between the sliding surfaces by viscosity through the rotation of the eccentric portion 51. The oil sent out from within the oil groove 64 to between the sliding surfaces causes a differential pressure to arise inside the oil groove 64, whereby oil is fed forcedly into the oil groove 64 in succession by the resultant differential pressure. Thus, the oil groove 64 is always filled with oil. As a result of this, oil can be fed to the sliding portions positively. Still, since the oil groove 64 is formed over the entire axial length of the roller 6, oil can be positively supplied over the entire outer peripheral surface of the eccentric portion 51 from the oil groove 64. In this way, oil can be positively fed to the sliding portions of the roller 6 and the eccentric portion 51 from the counter loaded side of the roller 6 by way of the oil groove 64, and moreover the oil fed from the oil groove 64 can be successfully fed to the sliding surfaces on the loaded side through the rotation of the eccentric portion 51. Accordingly, although the roller 6 does not rotate itself, the lubrication between the outer peripheral surface of the eccentric portion 51 and the inner peripheral surface of the roller 6 can be improved. Therefore, even if demanding lubricating conditions are involved such as in an overloaded operation, the compressor can be prevented from wear and seizure so that its machine reliability can be improved.

Figure 4A:
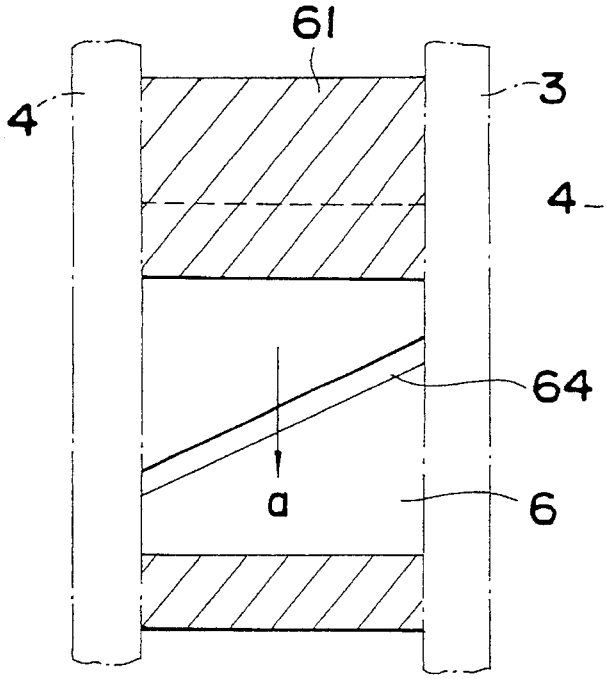
FIGS. 4A and 4B are sectional views of modifications of the roller.
Figure 4B:
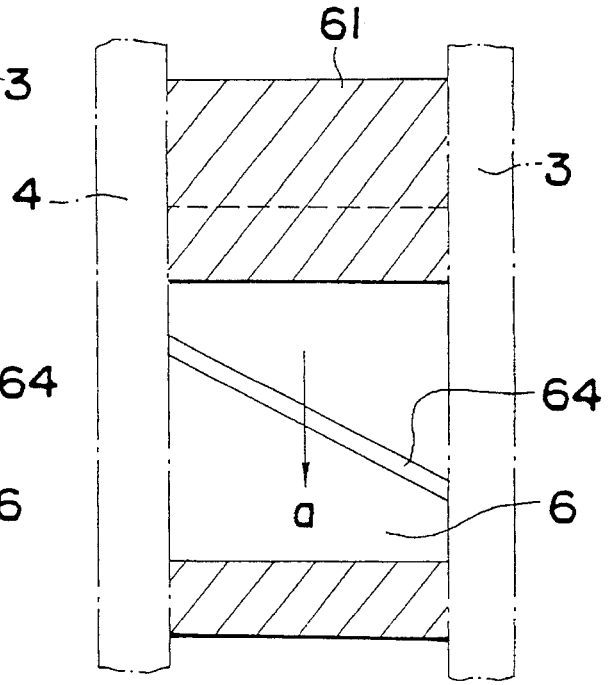

Although the oil groove 64 has been formed parallel to the axial direction of the roller 6 in the above first embodiment, the oil groove 64 may also be formed obliquely as shown in FIGS. 4A and 4B. In more detail, when oil fed through the oil feed hole 53 formed on the front head 3 side of the drive shaft 5 is reserved in the space 71 in an amount larger than on the rear head 4 side, as in vertical compressors, forming the oil groove 64 slantingly in the rotating direction a of the drive shaft 5 from the front head side toward the rear head side as shown in FIG. 4A allows the oil reserved more in the space 71 on the front head side to flow positively toward the rear head from the opening open toward the front head so that more successful lubrication can be attained at the sliding portions. Also, when oil fed through the oil feed hole 54 on the rear head 4 side is larger in volume than oil fed through the oil feed hole 53 on the front head side so that oil is reserved in the space 72 on the rear head side in an amount larger than in the space 71 on the front head side, forming the oil groove 64 slantingly in the counter-rotating direction of the drive shaft 5 from the front head side toward the rear head side, as shown in FIG. 4B, allows the oil reserved in the space 72 on the rear head side to flow positively from the opening toward the front head. In either case, by forming the oil groove 64 slantingly, oil can be fed from one side on which more oil is reserved, to the other side via the oil groove 64. Accordingly, the lubrication at the sliding portions can be attained more successfully to a corresponding extent.

Figure 5:
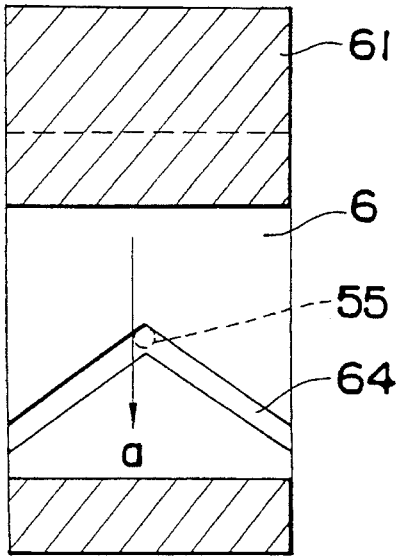
FIG. 5 is a sectional view of another modification of the roller.
Figure 6:
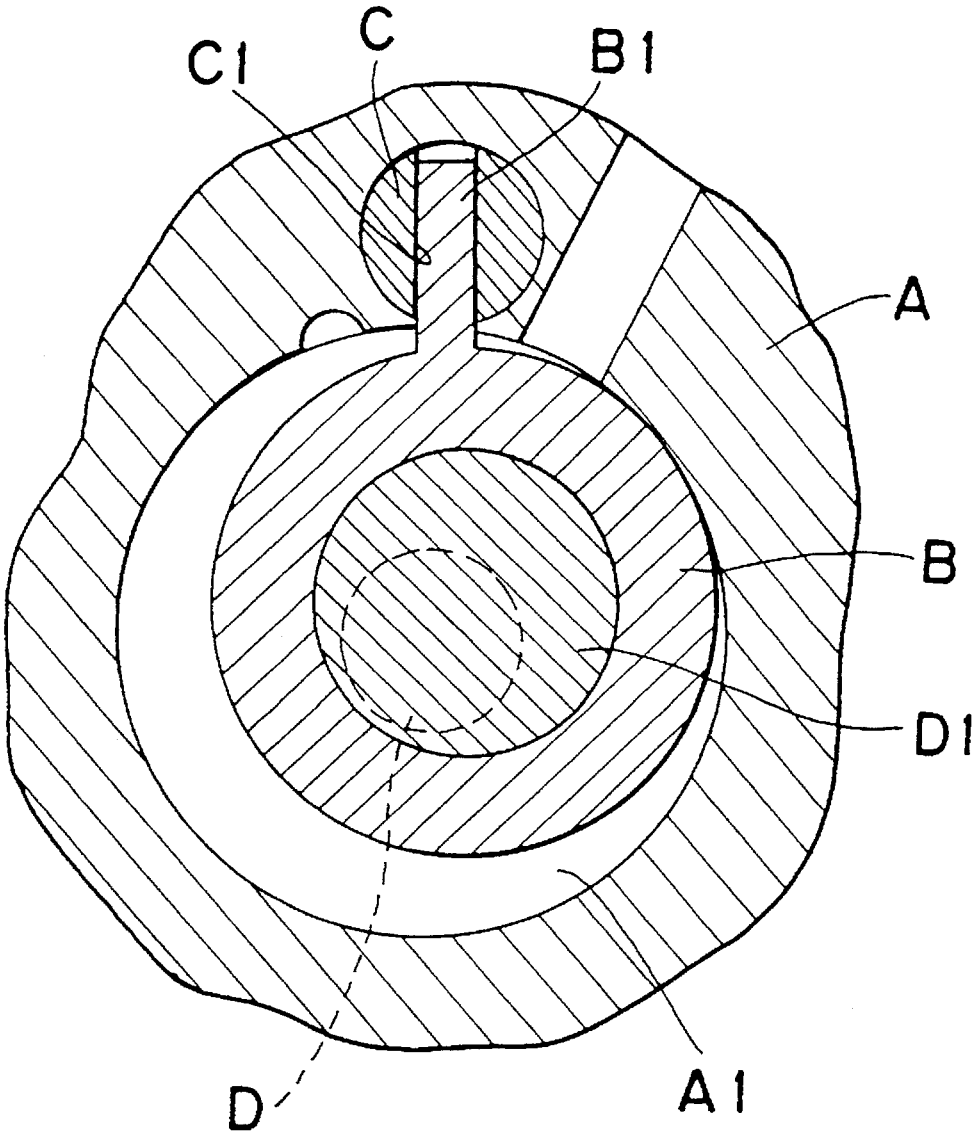
Fig. 6 BACKGROUND ART
FIG. 6 is a transverse sectional view of the compression unit of a conventional swing type rotary compressor.

Further, when the oil feed hole 55 is formed in the eccentric portion 51 and the outer peripheral surface of the eccentric portion 51 is lubricated with the oil fed through the oil feed hole 55, it is preferable to form the oil groove 64 in a V shape so that the groove slants from a portion of the roller 6 opposite to the oil feed hole 55 of the eccentric portion 51, forward in the rotating direction of the eccentric portion 51, as shown in FIG. 5. In this way, oil that flows out from the oil feed hole 55 formed at an axially intermediate portion of the eccentric portion 51 is forced to flow axially outwardly within the oil groove 64 as the drive shaft 5 rotates, while the oil is taken in between the sliding surfaces by the outer peripheral surface of the eccentric portion 51 so as to be dispersed to both the front head side and the rear head side. Thus, the oil can be fed to the entire sliding surfaces of the inner periphery of the roller 6 and the outer periphery of the eccentric portion 51.

INDUSTRIAL APPLICABILITY

The swing type rotary compressor of the present invention is used primarily for use in refrigerators.

I claim:

1. A swing type rotary compressor comprising:

a cylinder having a cylinder chamber formed therein;

a roller fitted around an eccentric portion of a drive shaft and installed in said cylinder chamber;

a blade provided integrally with and projecting from said roller and dividing said cylinder chamber into a compression chamber and a suction chamber;

a support member swingably provided in said cylinder and having a receptive groove for receiving a tip portion of the blade in such a way that the tip portion can freely move forward and backward; and an oil groove formed on an inner peripheral surface of said roller only on a counter loaded side and within a range from a first position where said blade projects therefrom to a second position displaced from the first position 180 degrees in a rotating direction of the drive shaft, said oil groove extending the entire axial length of the roller and being opened at both axial end faces of said roller for providing a continuous supply of oil therebetween.

2. The swing type rotary compressor according to claim 1, wherein said oil groove is slanted relative to the axial direction of the roller.

3. The swing type rotary compressor according to claim 1, wherein said oil groove is slanted from a portion of the roller opposite to an oil feed hole of said eccentric portion forward in the rotating direction of the eccentric portion.

4. The swing type rotary compressor according to claim 1, wherein said roller revolves around the drive shaft through the rotation of the drive shaft and does not rotate.

5. The swing type rotary compressor according to claim 1, wherein said support member includes two semi-cylindrical shaped members mounted adjacent to each other with said receptive groove being disposed therebetween for receiving the tip portion of the blade.

6. The swing type rotary compressor according to claim 5, wherein the tip portion of the blade is radially received within said receptive groove.

7. The swing type rotary compressor according to claim 1, wherein a space if formed within said cylinder chamber by an inner surface of said roller and the eccentric portion of the drive shaft for forming an oil reservoir.

8. The swing type rotary compressor according to claim 1, and further including an oil passage formed in said drive shaft for supplying oil to said oil groove formed on the inner peripheral surface of said roller.

9. The swing type rotary compressor according to claim 8, wherein said oil passage extends axially along the length of said drive shaft and radially within the eccentric portion to supply oil to said oil groove.

10. The swing type rotary compressor according to claim 1, wherein said oil groove is formed in the shape of a chevron.

* * * * *